United States Patent [19]

Gross et al.

[11] 4,376,924

[45] Mar. 15, 1983

[54] SELF-CONVERGING TELEVISION DISPLAY SYSTEM

[75] Inventors: Josef Gross, Princeton; William H. Barkow, Pennsauken, both of N.J.; John W. Mirsch, Levittown, Pa.

[73] Assignee: RCA Corporation, New York, N.Y.

[21] Appl. No.: 385,130

[22] Filed: Jun. 4, 1982

[51] Int. Cl.[3] ..... H01F 5/00

[52] U.S. Cl. ..... 335/210; 335/213

[58] Field of Search ..... 335/210, 212, 213

[56] References Cited

U.S. PATENT DOCUMENTS

| | | | |
|---|---|---|---|
| 4,041,428 | 8/1977 | Kikuchi et al. . | |
| 4,110,793 | 8/1978 | Tajiri | 335/210 X |
| 4,122,422 | 10/1978 | Hasegawa et al. | 335/213 |
| 4,143,345 | 3/1979 | Barkow | 335/210 X |

OTHER PUBLICATIONS

Article "Applications of Aberration Theory to the Deflection Yoke Design of a Color Picture Tube" by Y. Nakamura, et al. published in SID 82 Digest.

*Primary Examiner*—George Harris

*Attorney, Agent, or Firm*—Eugene M. Whitacre; Paul J. Rasmussen

[57] ABSTRACT

A self-converging color television display system utilizes a saddle-toroid deflection yoke. The length of the horizontal coil conductors adjacent the flared picture tube portion is limited to reduce stored energy. The length of the core also is limited and disposed longitudinally between the end turns of the horizontal saddle coils at a position to mitigate convergence trilemma as well as North-South pincushion distortion.

3 Claims, 3 Drawing Figures

SELF-CONVERGING TELEVISION DISPLAY SYSTEM

This invention relates to a television display system utilizing an improved self-converging arrangement of a picture tube and a deflection yoke.

A common arrangement of a self-converging color television display system includes a color television picture tube utilizing three horizontal in-line beams which are deflected by an electromagnetic deflection yoke which maintains convergence of the beams as they are scanned over the viewing screen of the picture tube. For this purpose, the horizontal coils of the deflection yoke are wound to produce a net pincushion shaped deflection field and the vertical coils are wound to produce a net barrel-shaped field. Generally, this combination of deflection fields provides convergence of the beams during scanning. A preferred form of this type of deflection yoke is a so-called saddle-toroid yoke. In such a yoke, the horizontal coils are saddle wound and thus have two longitudinally extending groups of active conductive turns joined at the front and rear by transversely extending front and rear groups of return conductors. The vertical coils are toroidally wound on a generally flared cylindrical ferrite core. The vertical coils and core are nested within and surround the horizontal coils.

Much effort has been expended to seek an ideal combination of coils, core and picture tube parameters to achieve the best possible convergence, lowest consumption of power, the least amount of ferrite and copper wire, minimum defocusing of the beams caused by the deflection yoke and minimum pincushion distortion of the raster formed on the viewing screen. An optimum tradeoff among performance, power consumption, and cost is a problem in design of a color display system. This problem increases in complexity as picture tubes with wider deflection angles such as 110° are utilized especially as the size of the viewing screen is increased. It has been recognized that a serious problem called the "convergence trilemma" exists in wide-angle picture tubes. This trilemma problem is illustrated in FIG. 1 which depicts the upper right hand quadrant of a display on a television picture tube viewing screen. In this FIGURE, it is presumed that when viewed from the viewing screen end of the picture tube, the electron beams are emitted by an electron gun assembly in the order shown with the blue beam on the left, the green beam in the center and the red beam on the right. The convergence trilemma problem is described in the difference between the convergence of the red and blue rasters. In FIG. 1, the red raster is illustrated by the solid lines and the blue raster is illustrated by the dashed lines. The horizontal misconvergence of red and blue vertical lines at the top central portion of the raster is labelled $C_V$. At the right-hand side of the raster along the X axis, a misconvergence $C_H$ exists, which is the horizontal misconvergence of vertical red and blue lines at this point. In the upper right-hand corner of the raster there is a misconvergence labelled T, which is trap, which is the vertical separation of horizontal red and blue lines. In FIG. 1, with the beam orientation as illustrated, the trap is negative because the corner of the blue raster is lower than that of the red raster. The convergence trilemma is expressed as:

$$\text{Trilemma} = C_H - C_V + T$$

Thus, the trilemma is the sum of the on-axis misconvergences and trap. With the axes converged, the remaining trap is equal to trilemma. This residual trap varies from a positive value for tubes with a short throw to a negative value for tubes with a long throw. Throw is the distance from the deflection center of the display system to the viewing screen. This distance increases as the viewing screen size is increased. In the past, the performance limitation caused by the trilemma problem was mitigated in some designs by increasing the stored energy of the deflection yoke and/or the cost of the deflection system. Such a compromise is obviously not desirable. In accordance with an aspect of the invention, the trilemma problem is mitigated by a combination of a horizontal in-line beam color television picture tube and a self-converging saddle-toroid deflection yoke in which the longitudinal dimension of the active conductor turns of the saddle coils which are disposed against the flared tube envelope portion is not greater than 1.2 times the nominal outside diameter of the neck portion of the picture tube. Also, the longitudinal dimension of the toroidal core is not greater than the nominal outside diameter dimension of the neck of the picture tube with which the deflection yoke is operated. Further, this relatively short core and vertical coil assembly is disposed between the end turns of the horizontal saddle coils in a longitudinal sense without touching said end turns. This combination minimizes the trilemma effect, decreases the stored energy and also results in a compact deflection yoke which decreases the ferrite and copper costs.

Figure 2:
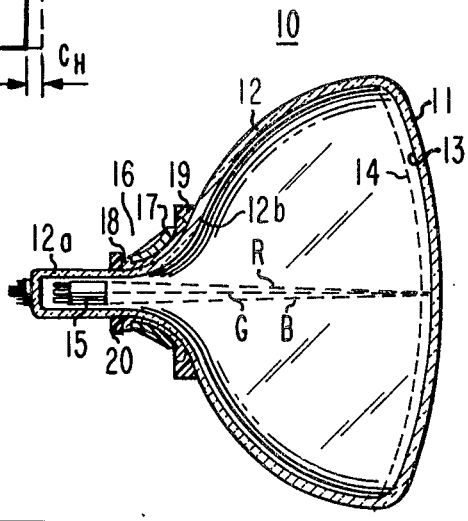
FIG. 2 illustrates generally a display system embodying the invention.

In FIG. 2, a self-converging display system 10 in accordance with the invention includes a picture tube having a glass envelope 12. At the front of envelope 12 is a faceplate 11 having deposited on the inside thereof a repetitive pattern of red, green and blue phosphor elements 13 which forms the viewing screen of the picture tube. The envelope 12 includes a flared portion **12*b* which joins with a cylindrical neck portion 12*a*. Mounted within the glass envelope 12 is an electron gun assembly 15 which produces three horizontal in-line beams labelled R, B and G which are directed through an aperture mask 14 to impinge upon their respective color phosphor elements 13**.

Disposed adjacent the neck and funnel portions **12*a* and 12*b* of the glass envelope is a deflection yoke assembly 16. The yoke assembly includes a flared cylindrical ferrite core 17 having conductor turns toroidally wound thereabout to form a pair of toroidal vertical deflection coils. Surrounded by the flared core and vertical coils are a pair of saddle coils 18 which provide for horizontal deflection of the electron beams. The core and coils are held relative to each other by a yoke mount 19. Disposed at the rear of the yoke assembly 16 is a static convergence and purity assembly 20 which may be of conventional design. Yoke assembly 16 is of the self-converging type described above. Although no details are shown, yoke assembly 16 may be positioned relative to the picture tube such as by tilting the front end thereof to optimize the overall convergence pattern. The yoke may be fixed in the optimum position by means of rubber wedges, not shown, slid between the yoke assembly and the glass envelope 12**.

Figure 3:
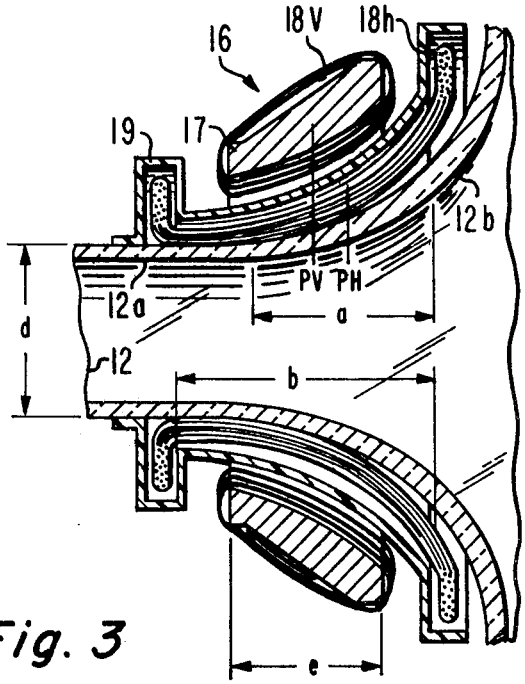
FIG. 3 illustrates in more detail the deflection yoke components in relation to the picture tube in accordance with the invention.

FIG. 3 illustrates in more detail a cross sectional view of the deflection yoke and picture tube assembly of FIG. 2 in accordance with the invention. The deflection yoke assembly is shown mounted in operating relationship relative to the picture tube and is positioned adjacent the neck portion 12*a* and the flared portion 12*b* of the glass envelope. The yoke assembly 16 is shown pulled back from the flared portion 12*b* in a position which provides purity and clearance of the beams from the flared envelope portion 12*b* during deflection so that no neck shadow results. The window portion of the horizontal saddle deflection coils has a longitudinal dimension b which is determined by the front and rear groups of return conductors represented by the dotted end portions of the conductors in the FIGURE. The ferrite core 17 with its accompanying toroidally wound vertical deflection coils 18V is disposed outside of the horizontal deflection coils which are mounted in the insulator yoke mounting assembly 19. It can be seen that the total longitudinal dimension e of the core is no greater than the nominal outside diameter dimension d of the neck portion 12*a* of the glass envelope. It is also noted that the core 17 lies within the window region b of the horizontal deflection coils. The horizontal deflection coils have a rearward portion which lies adjacent the neck portion 12*a* of the glass envelope and a flared portion which lies adjacent the flared portion 12*b* of the glass envelope. It is noted that the length of the active conductors of the coils which lie adjacent the flared portion of the glass envelope have a longitudinal dimension a. Dimension a is no greater than 1.2 times the outside neck diameter dimension d.

Figure 1:
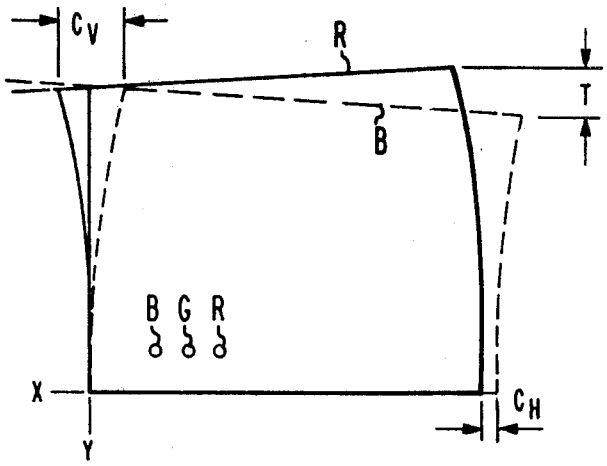
FIG. 1 illustrates the trilemma convergence problem as observed in the upper right quadrant of a television display.

The positioning longitudinally of the vertical deflection coil relative to the horizontal deflection coil is such as to place the vertical deflection center $P_V$ rearward of the horizontal deflection center $P_H$. This relative positioning serves to decrease the trilemma convergence error illustrated in FIG. 1.

Limiting the length in the longitudinal direction of the core and of the vertical coils reduces the amount of ferrite and copper conductor utilized.

Furthermore, the positioning of the core 17 and vertical coils 18V rearward from the front of the horizontal coil window serves to reduce the North-South pincushion distortion. A barrel-shaped vertical deflection field causes North-South pincushion distortion, the magnitude of which increases with increased horizontal deflection, such as at the exit end of the yoke. Positioning the barrel-shaped vertical deflection field rearward from the exit end of the yoke in accordance with the FIG. 3 arrangement serves to eliminate additional pincushion correction apparatus such as permanent magents disposed at the exit end of the yoke.

Since the amount of horizontal conductors which are disposed adjacent the flared portion of the glass envelope are limited in their longitudinal direction, the maximum diameter of the horizontal coils at the exit end of the deflection yoke is also limited. This decreases the amount of copper conductor utilized for the horizontal coils. Since the coils also extend along the neck portion 12*a* of the glass envelope, deflection sensitivity is enhanced because of the closer proximity of the field producing conductors to the beams. Hence, a reduction in scanning current results. This simplifies the horizontal deflection circuitry since less power is required to deflect the beams. Since the stored energy of the horizontal coils is given by the expression:

$$\text{Stored Energy} = LI^2/2$$

the reduced scanning current results in less stored energy. Less heat dissipation and greater reliability are advantageous in products of this design.

The dimension b in FIG. 3 is also the total longitudinal length of the active horizontal coil conductors. The difference b minus a is the longitudinal length of the straight conductors extending along the cylindrical portion 12*a* of the glass envelope. The length b in accordance with the invention is at most 1.6 times d. This length b will in general decrease with an increasing tube throw at some penalty in stored energy.

What is claimed is:

1. A self-converging television display system comprising:

a color television picture tube including a glass envelope having a cylindrical neck portion of a nominal outside diameter at one end of said picture tube which encloses an electron gun assembly for producing three horizontal in-line beams, said neck portion joining an outwardly flared portion of said envelope which encloses at the other end of said picture tube a faceplate having colored phosphor elements deposited on the inside surface thereof; and a self-converging deflection yoke assembly producing a pincushion-shaped horizontal deflection field and a barrel-shaped vertical deflection field mounted in operating relationship adjacent the neck and flared portions of said tube, said yoke assembly comprising a pair of vertical deflection coils toroidally wound about a ferrite core and a pair of diametrically oppositely disposed saddle-type horizontal deflection coils disposed adjacent the inside surface of said vertical coils, each of said horizontal saddle coils having two groups of active conductor turns generally longitudinally disposed and joined at their respective front and rear end portions by respective forward and rearward groups of return conductor turns, said active and return conductor portions forming a window area of said coil, the longitudinal dimension of said active turns adjacent said flared envelope portion being no greater than 1.2 times said neck nominal outside diameter dimension, and said core having a longitudinal dimension no greater than said neck nominal outside diameter dimension and being disposed within the longitudinal dimension of said window area so as to be set back from the forward return conductor group and set forward from the rearward return conductor group.

2. A self-converging television display system according to claim 1 wherein the total length of said active conductor turns in the longitudinal direction is no greater than 1.6 times said neck nominal outside diameter dimension.

3. A self-converging television display system according to claim 2 wherein the plane of the peak vertical deflection field is located rearwardly of the plane of the peak horizontal deflection field.

* * * * *